US005879235A

United States Patent [19]

Kaneko et al.

[11] Patent Number: 5,879,235

[45] Date of Patent: Mar. 9, 1999

[54] BALL GAME MACHINE WITH A ROULETTE-TYPE ROTARY DISK AND A DISPLAY LOCATED IN THE CENTRAL AREA THEREIN

[75] Inventors: Makoto Kaneko; Yasuo Jin; Shingo Kataoka; Takanori Akiyama, all of Tokyo, Japan

[73] Assignee: Sega Enterprises, Ltd., Tokyo, Japan

[21] Appl. No.: 711,738

[22] Filed: Sep. 10, 1996

[30] Foreign Application Priority Data

Sep. 12, 1995 [JP] Japan ..... 7-259267

[51] Int. Cl.[6] ..... A63F 5/00

[52] U.S. Cl. ..... 463/34; 463/17; 463/31; 273/142 R

[58] Field of Search ..... 463/17, 30, 31, 463/34, 16; 273/142 A, 142 R, DIG. 26, 142 E, 142 F

[56] References Cited

U.S. PATENT DOCUMENTS

| | | | |
|---|---|---|---|
| 4,322,080 | 3/1982 | Pennington | 273/86 B |
| 4,323,241 | 4/1982 | Deutsch | 273/121 A |
| 4,869,505 | 9/1989 | Manabe | 273/142 R |
| 5,188,363 | 2/1993 | Marnell, II et al. | 273/85 CP |
| 5,320,351 | 6/1994 | Suzuki | 273/86 B |

FOREIGN PATENT DOCUMENTS

| | | |
|---|---|---|
| 5-29575 | 4/1993 | Japan . |
| 2585714 | 12/1996 | Japan . |
| 2 084 830 | 4/1982 | United Kingdom . |

*Primary Examiner*—Jessica J. Harrison
*Assistant Examiner*—James Schaaf
*Attorney, Agent, or Firm*—Dickstein, Shapiro, Morin & Oshinsky, LLP

[57] ABSTRACT

A roulette-like ball game machine has a rotary disk with a plurality of pockets arranged in a peripheral direction and assigned a number respectively, and a guide circle provided around the rotary disk at a somewhat higher position and joining to the rotary disk through an inclined surface. While the rotary disk is turned, a ball rolled along the guide circle falls inside and enters one of the pockets to decide a prize number. In such a ball game machine, a plurality of operation stands are arranged around the guide circle, the rotary disk is formed in an annular shape having a large inner diameter, a large-sized picture surface is provided within the central space of the rotary disk and various pictures are projected on the picture surface by an image projector.

7 Claims, 11 Drawing Sheets

BALL GAME MACHINE WITH A ROULETTE-TYPE ROTARY DISK AND A DISPLAY LOCATED IN THE CENTRAL AREA THEREIN

BACKGROUND OF THE INVENTION

The present invention relates to a roulette-like ball game machine which can be utilized for a bingo game, a cards game and the like as well as the original roulette game.

In the actual roulette game, after a plurality of players bet a suitable number of chips on numbers selected by them respectively, a dealer turns a rotary disk having a plurality of pockets arranged circumferentially and then throws-in a ball along a guide circle provided round an outer periphery of the rotary disk so that the ball rolls guided by the guide circle in a direction opposite to the turning direction of the rotary disk.

The ball rolls along the guide circle owing to a centrifugal force at first, but when the rolling speed is lowered and the centrifugal force is reduced, the ball separates from the guide circle, moves toward the inside to reach the rotary disk and enters into any one of the pockets.

The pockets have corresponding numbers respectively, and an allotment is given to a player who betted on the number of the pocket the ball enters. The chips of the other players are confiscated.

Japanese Utility Model Laid-Open Publication No. Hei 5-29575 proposes a machine having a rotary disk driven by a motor to rotate, a plurality of operation stands arranged round a periphery of a roulette-like ball game machine and a large-sized screen erected vertically in the rear.

Namely, in this machine, as shown in FIG. 15, a plurality of operation stands 05 are arranged around a ball game machine 01 and a large-sized screen 08 is erected at a position biased on one side. On each of the operation stands 05 are provided a display monitor 06, an operation button section 07 and the like for each player.

The ball game machine 01 has a center mound 03 swelling up gently formed at a center of a rotary disk 02 integrally to turn together with the rotary disk 02 similarly to an actual roulette having a rotary disk turned by hand.

Each player faces to any one operation stand 05 to operate the operation button section 07 looking at the monitor 06 and in case of the roulette game he bets chips on a certain number and watches the ball game machine 01.

The ball game machine 01 shoots out a ball 09 to a guide circle 04 on an outer periphery of the turning rotary disk 02 in a direction opposite to the turning of the rotary disk. The ball 09 shot out vigorously rolls along the guide circle 04 owing to centrifugal force at first, but when the rolling speed is lowered, the ball 09 drops toward inside by its own weight and enters into a certain pocket on the turning rotary disk. If a number corresponding to the pocket into which the ball enters coincides with a number betted by a player, an allotment is given to him, therefore the players trace the ball 09.

Meanwhile, a picture on the screen 08 does not attract the player's attention and is ignored, therefore it cannot be expected that the screen exhibits a visual effect sufficient to excite the players.

The player is put to trouble because he must watch the monitor 06 and further the large-sized screen 08 with line of sight largely altered in addition to watching the ball game machine 01.

On the one hand, the large-sized screen 08 elected along the ball game machine requires an extra installation space so that the number of operation stands is limited to reduce the number of players who can play simultaneously.

SUMMARY OF THE INVENTION

The present invention has been accomplished in view of the foregoing and an object of the present invention is to provide a roulette-like ball game machine wherein a visual effect can be given to players without trouble for players to alter their lines of sight when the ball rolls, and installation space efficiency is good to increase the number of players who can play simultaneously.

In order to achieve the above object, according to the present invention, there is provided a ball game machine having a rotary disk with a plurality of pockets arranged in a peripheral direction and assigned a number respectively, and a guide circle provided around the rotary disk for guiding a rolling ball along, characterized by a plurality of satellites, each of which includes an operation stand arranged around the guide circle, the rotary disk formed in an annular shape having a large inner diameter, a large-sized picture surface provided within a central space of the rotary disk, and a picture formation means for forming various pictures on the picture surface.

In this ball game machine, since the large-sized picture surface is formed at the center of the ball game machine, the ball rolls around the picture surface, so that the player's eyes tracing the rolling ball catch the large-sized picture surface naturally, thus it is possible to give the player a visual stimulus and make him be more enthusiastic about the game.

The players facing to the satellites around the guide circle are not put to trouble because the player's eyes catch pictures on the central picture surface naturally without altering their lines of sight largely.

Since the large-sized picture surface is formed utilizing the central space of the rotary disk, a special space for the picture surface is unnecessary and a good installation space efficiency is attainable.

Further, the number of satellites is not limited by the picture surface so that the number of players who can play simultaneously can be increased.

The large-sized picture surface may be a large-sized circular screen spread generally in a plane and the picture formation means may be an image projector adapted to project various images onto the large-sized screen. In this configuration, pictures which can be more easily seen by the players are provided.

If the image projector as the picture formation means is constituted so as to project images matched with the shape of the large-sized circular screen, it can be prevented that a light reflects on a part other than the screen to influence the projected images.

If two sets of the image projector are used as the picture formation means, images having sufficient brightness can be projected on the large-sized screen.

If each of the two image projectors has three tubes of red, green and blue and corresponding tubes of the same color of both image projectors are arranged at positions symmetrical with each other, occurrence of patched color can be prevented.

The picture formation means may be controlled by a control means for controlling progress of the game for changing the pictures in accordance with the progress of the game. According to this configuration, it is possible to provide pictures matching with the game progress to the players, facilitate the play and give a strong visual effect to the players.

DETAILED DESCRIPTION OF THE PREFERRED EMBODIMENT

Hereinafter a preferred embodiment of the present invention will be described with reference to FIGS. 1 to 14.

Figure 1:
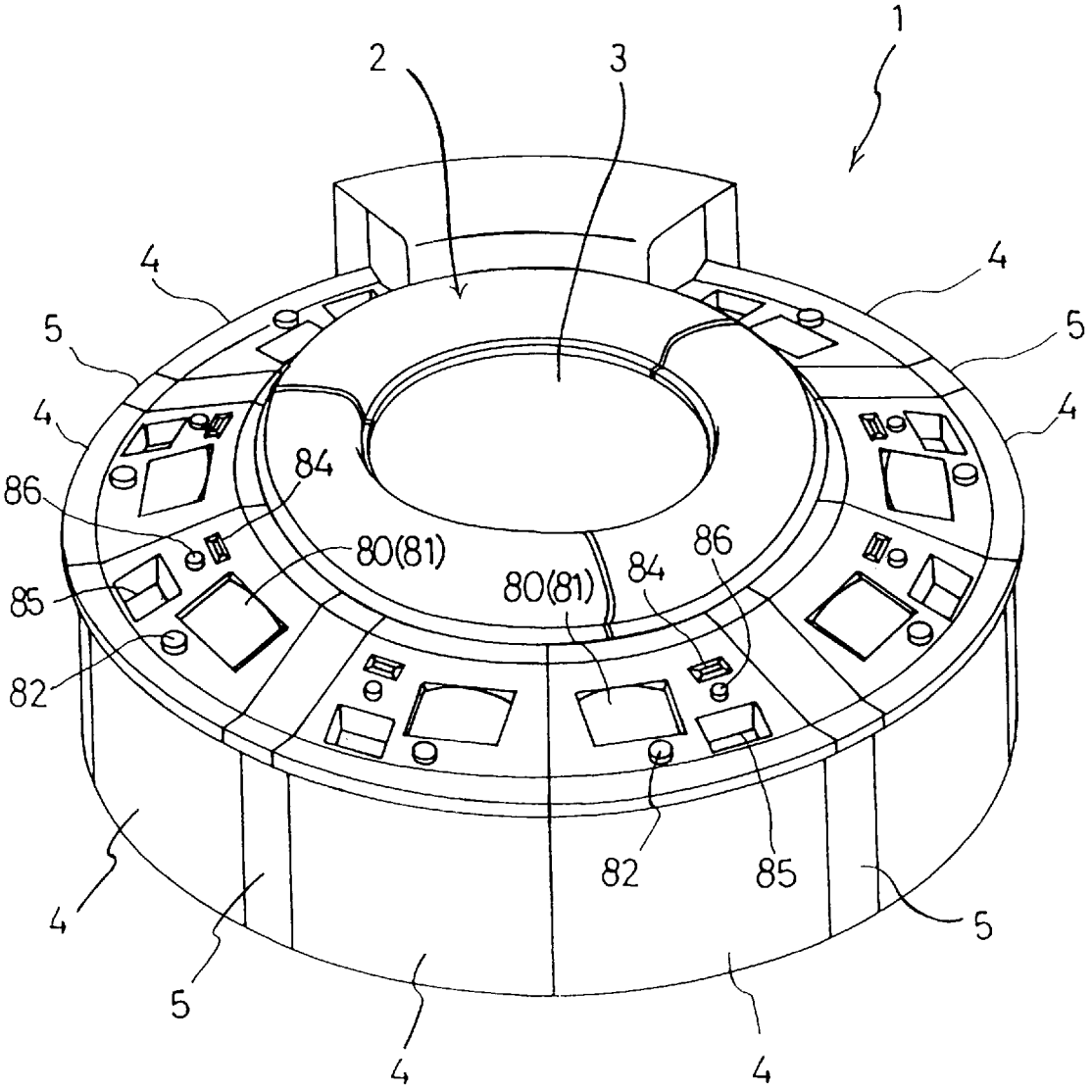
FIG. 1 is an outside view of a ball game machine according to a preferred embodiment of the present invention.

FIG. 1 is an outside view of a roulette-like ball game machine 1 according to the preferred embodiment. A large-sized annular roulette 2 of about 1500 mm outer diameter and about 900 mm inner diameter is arranged at the center of the machine and a large-sized circular screen 3 is spread over a circular space inside of the roulette 2. And a plurality of satellites 4 and exchange apparatuses 5 interposed between adjacent satellites are arranged around the roulette 2.

Since the large-sized screen 3 is arranged utilizing the central space of the roulette 2, a special space for providing the large-sized screen otherwise is unnecessary, a good space efficiency is attainable, the space for installation of the satellites is not limited by the large-sized screen and a sufficient number of the satellites can be installed easily so that many players can play simultaneously.

A rough constitution of the ball game machine will be described based on the disassembled perspective view shown in FIG. 2. A cylinder member 10 is positioned in the center and the large-sized screen 3 is spread over an upper opening of the cylinder member 10 fixed to the member along the opening edge. The cylinder member 10 is surrounded by three split pedestal frames 11 which are assembled in a tubular shape, and around the pedestal frames 11 are arranged the satellites 4 together with the exchange apparatuses 5.

The roulette 2 comprises a guide circle 12 fixedly supported by the pedestal frames 11 and a rotary disk 13 adapted to rotate at inside of the guide circle. The rotary disk 13 has a cylindrical part 13*a* and an opening edge at the lower end of the cylindrical part 13*a* is placed on rollers 9 arranged on an upward face formed at an upper inner periphery of the pedestal frames 11 so that the rotary disk is supported rotatably.

The guide circle 12 has a tapering face 12*a* gently inclined toward inside and a vertical guide face 12*b* extending along the outer periphery of the tapering face 12*a*. The guide face 12*b* guides a shot-out ball 6 (FIG. 4) against the centrifugal force to make the ball roll. When rolling speed of the ball is lowered and the centrifugal force is lost, the ball rolls down on the tapering face 12*a* toward the inside and reaches the rotary disk 13 which is turning.

On a radially inner side portion of an upper surface of the annular rotating disk 13 are formed thirty-eight pockets 15 by partition plates 14 arranged in the circumferential direction. On the outside of each pocket 15 is fitted a number plate 16 respectively. The number plate 16 is made of a semitransparent acrylic resin plate and inclined to join with the tapering face 12*a* of the guide circle 12 smoothly. On the number plates 16 are written different numbers in order.

Figure 3:
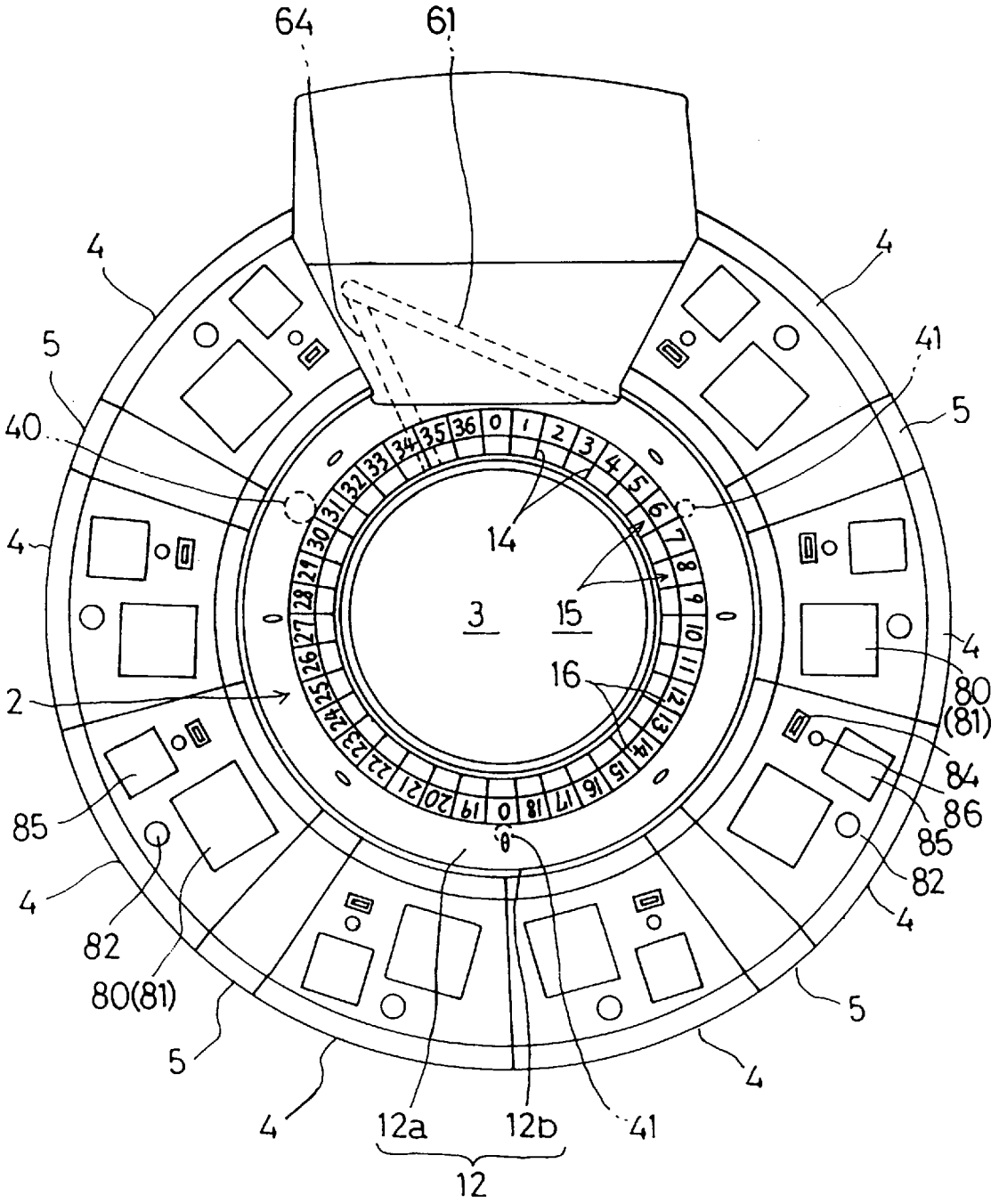
FIG. 3 is a plan view of the whole ball game machine.

In the actual roulette, these numbers are not arranged in order, however in the preferred embodiment, as shown in FIG. 3, a pair of "0" are arranged at symmetrical positions and numbers "1" to "36" are allocated to the remaining positions in order.

The ball 6 coming from the tapering face 12*a* of the guide circle passes on the number plates 16 at the outside of the turning rotary disk 13 and enters into one pocket 15. The number written on the number plate 16 corresponding to the pocket 15 into which the ball enters is regarded as the prize number.

Since the numbers corresponding to the pockets 15 respectively are arranged in order as mentioned above, it is easy for the players to grasp the situation or find the position of the number they have bet, therefore the players can watch whether the ball 6 enters into the pocket 15 having the number they have bet or not with a beating heart and a high excitement.

The pockets 15 formed by the partition plates 14 are rotatable, while a bottom plate 17 for the pockets 15 is projected from an outer peripheral surface of the cylinder element 10 annularly so as not to rotate.

The above of the roulette 2 comprising the guide circle 12 and the rotary disk 13 is covered with an annular cover member 18 made of a transparent acrylic resin.

Figure 11:
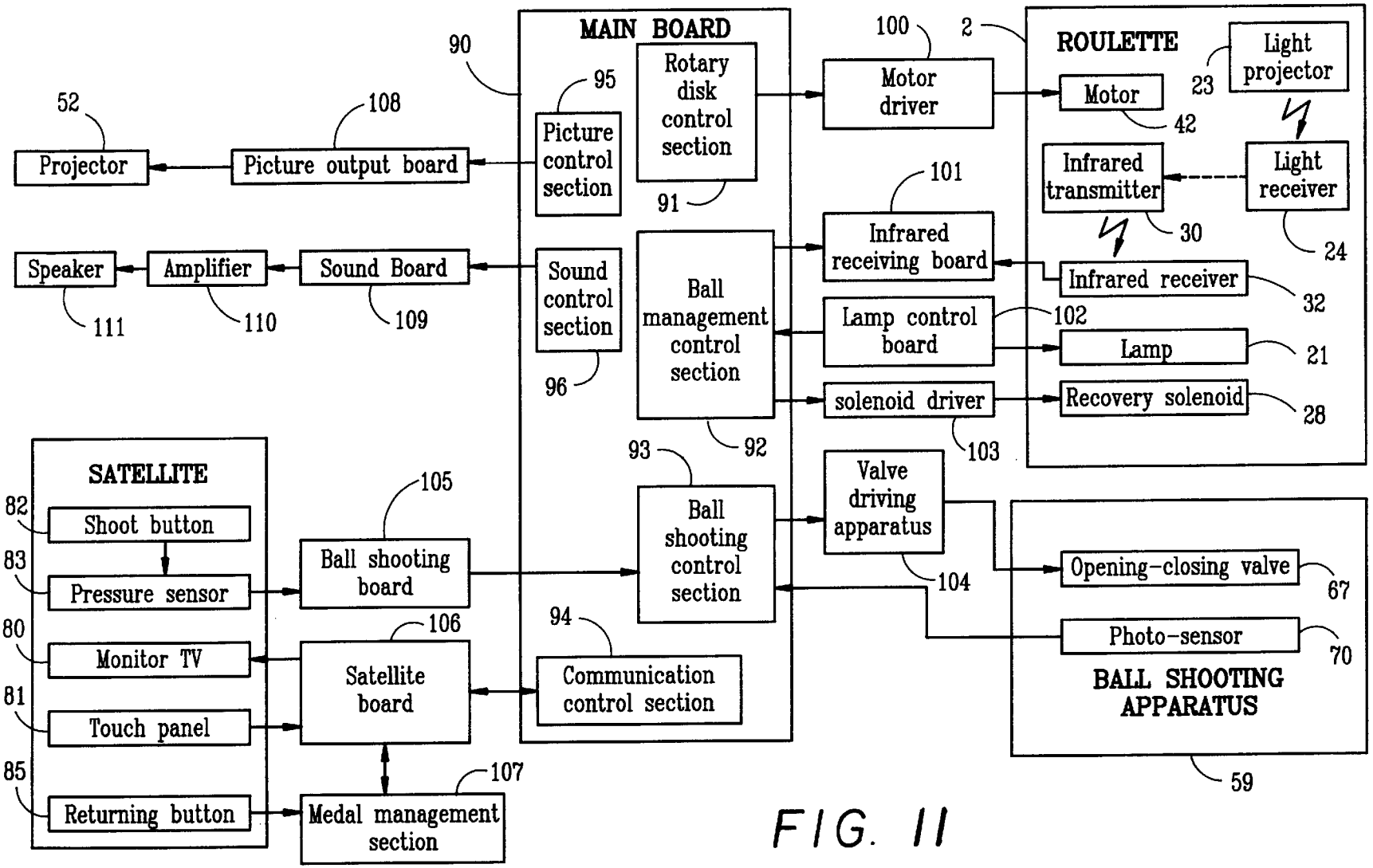
FIG. 11 is a rough block diagram of a control system in the present ball game machine.

A part of the annular bottom plate 17 of the pockets 15 is formed by a swingable ball recovery plate 27 which is swung by a recovery solenoid 28 (FIG. 11). When the recovery plate 27 is swung downward and the pocket 15 with the ball 6 reaches the position of the recovery plate 27, the ball falls to be recovered.

At a place where the ball falls is positioned an opening of a ball recovery pipe 64 which guides the recovered ball to a ball shooting apparatus 59 (FIG. 11) to be mentioned later.

Figure 4:
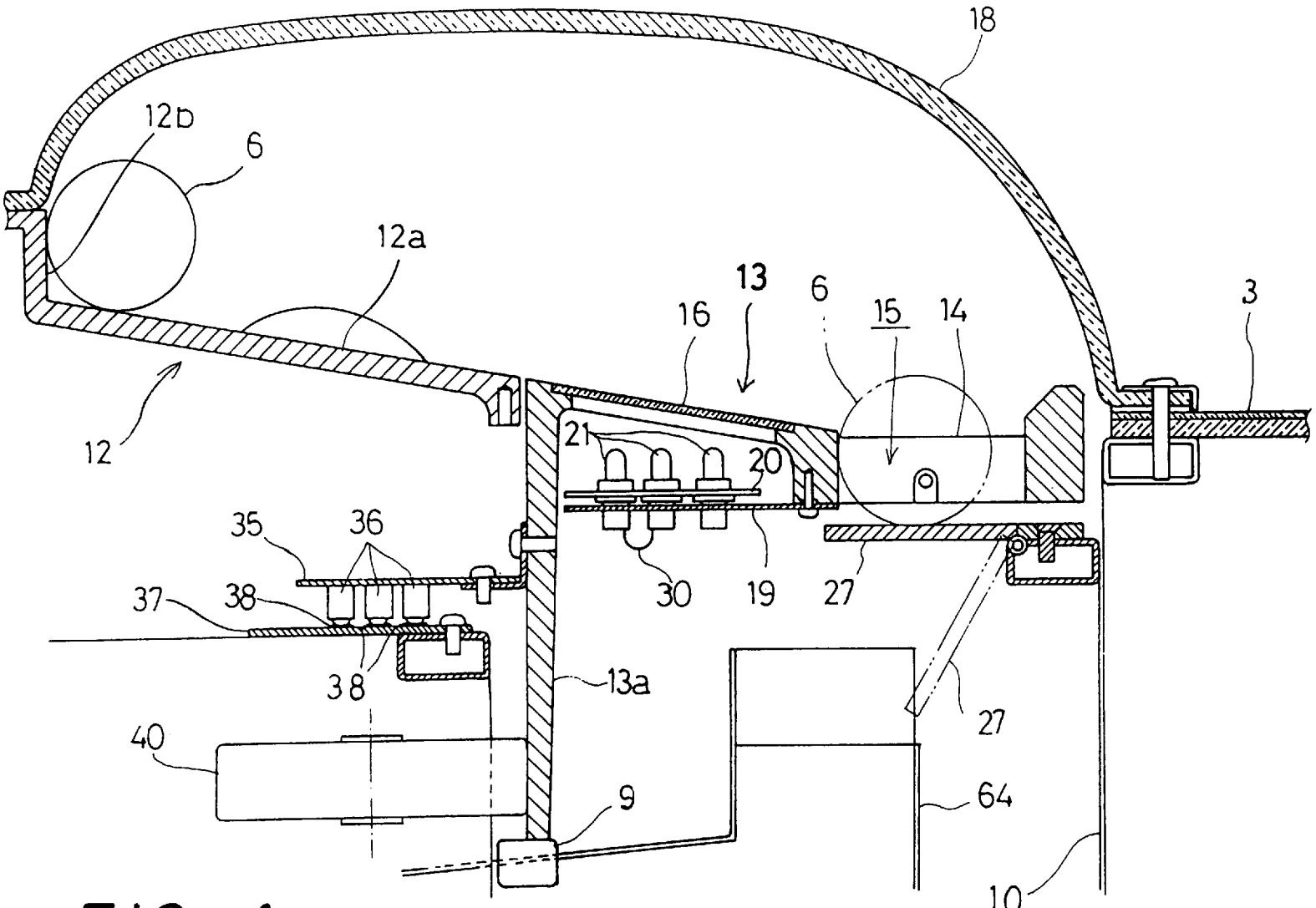
FIG. 4 is a section view of an essential part of a roulette.

As shown in FIG. 4, the under side of the number plate 16 of the rotary disk 13 is divided into thirty-eight small rooms corresponding to the pockets 15 respectively by partition plates. The small rooms have a bottom plate 19 and in each small room, a base plate 20 is provided on the bottom plate 19. On each base plate 20 are arranged three lamps 21. The number on the number plate 16 appears and disappears by turning on and off the lamps 21.

On the lower surface of the annular bottom plate 19 are provided three infrared transmitters 30 arranged circumferentially at regular intervals which project infrared rays diffusely downward for sending signals.

The partition plate 14 partitioning the pockets 15 has a scooped interior for wiring. Both side surfaces of the partition plate are cut partially and a light projector 23 and a light receiver 24 face to the cut out openings respectively from the interior.

Figure 5:
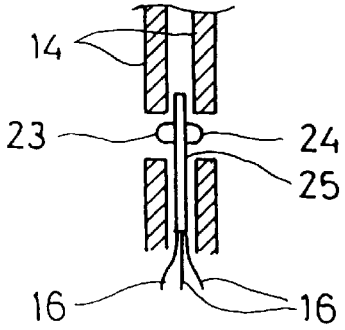
FIG. 5 is a section view showing an arrangement construction of a light projector and a light receiver.

As shown in FIG. 5, the light projector 23 and the light receiver 24 are provided on a common base plate 25 back to back. Three wires 16, namely, an earth wire, a electric power wire and a signal wire are extended from the base plate 25. On an ordinary occasion, five wires, that is, an electric power wire and an earth wire for the light projector 23 and an electric power wire, an earth wire and a signal wire for the light receiver 23, are required, but in this embodiment, the earth wire and the electric power wire are common to the light projector 23 and the light receiver 24 so that the number of wires is lessened to facilitate assembling work and the cost is reduced.

In a pocket 15, a light projected from the light projector 23 of the partition plate 14 on one side reaches the light receiver 24 of another partition plate 14 on the other side and if the ball 6 enters into this pocket 15, the light is intercepted by the ball 6 to detect existence of the ball.

When existence of the ball 6 in a pocket 15 is detected by the photo-sensor composed of the light projector 23 and the light receiver 24 in such a manner, the infrared transmitter 30 is controlled and driven to send light signals for turning on and off lamps 21 corresponding to the pocket 15. By the turning on and off of the lamps 21, the number of the corresponding number plate 16 appears and disappears to notify the player of the number.

Figure 6:
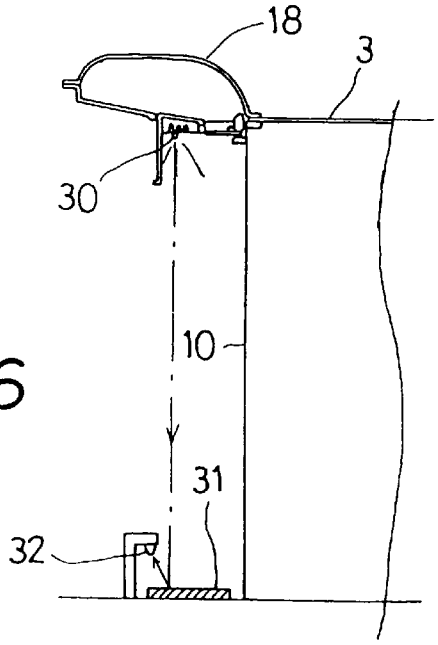
FIG. 6 is a section view showing an arrangement construction of an infrared transmitter and an infrared receiver.

As shown in FIG. 6, an annular reflecting plate 31 is laid under the infrared transmitters 30 which rotate and signals reflected by the reflecting plate 31 are received by an infrared receiver 32.

Because the reflecting plate 31 is laid on a lower place, mechanical limitations regarding installing positions of the infrared transmitter 30 and the infrared receiver 32 are reduced and the transmitter 30 and the receiver 32 can be installed with the light emitting face and the light receiving face directed in any direction respectively. Especially, by directing both the faces downward, dusts adhering to the faces can be reduced to ensure a certain signal transmission.

Dusts collecting on the upward reflecting face of the reflecting plate 31 do not transmit light well but reflect light well so that the transmission of the infrared signals is not hindered.

As shown in FIG. 4, on the outer peripheral surface of the cylindrical part 13*a* of the rotary disk 13 are provided a supporting plate 35 projecting radially and on the under surface of the supporting plate 35 are arranged radially three brushes 36 projecting downward.

On an upper surface of an annular base plate 37 provided at a top portion of the pedestal frame 11 are laid concentric three electric conductive rails 38 corresponding to the three brushes 36. By contacting the three electric conductive rails 38 and the three brushes 36 with each other, electric power is transmitted to the rotating rotary disk 13 side from the stationary pedestal frame 11 side. One of the three rails 38 is an earth line and the other two are electric power supplying lines for different voltages.

Figure 7:
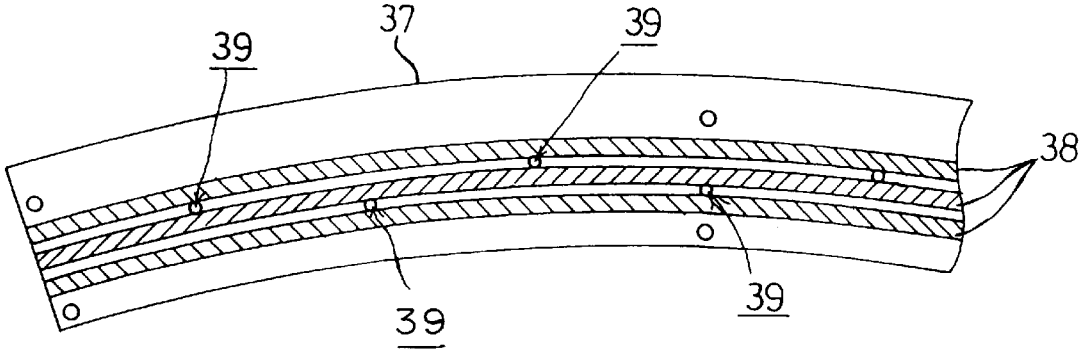
FIG. 7 is a top plan view of a base plate having three electric conductive rails.

As shown in FIG. 7, on concentric portions between adjacent electric conductive rails 38 are drilled round holes 39 in places. Metal powders produced by sliding contact of the rails 38 and the brushes 36 are dropped through the round holes 39 to prevent occurrence of a short circuit by the metal powders collected on the base plate 37.

A driving roller 40 and two idle rollers 41 (shown in FIG. 3 by dotted lines) are arranged along an upper inner peripheral edge of the pedestal frames 11 combined in an annular shape in equal intervals. These three rollers engage with an outer surface of the cylindrical part 13*a* of the rotary disk 13 for positioning the rotary disk. The rotary disk 13 is turned by the driving roller 40 which is rotationally driven by a motor 42.

Figure 8:
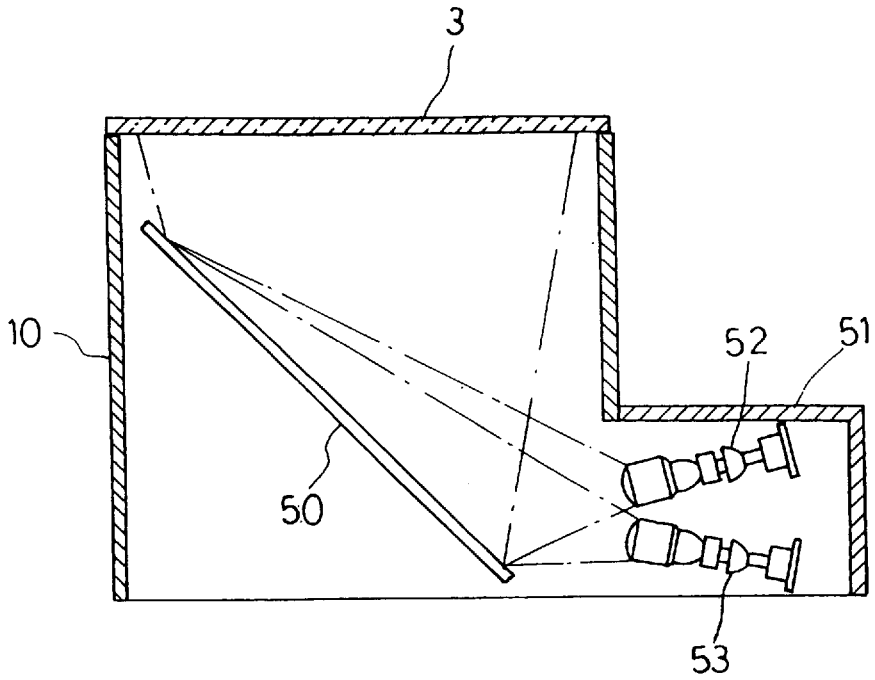
FIG. 8 is an explanatory view illustrating a structure for forming images on a large-sized screen by a projector.
Figure 9:
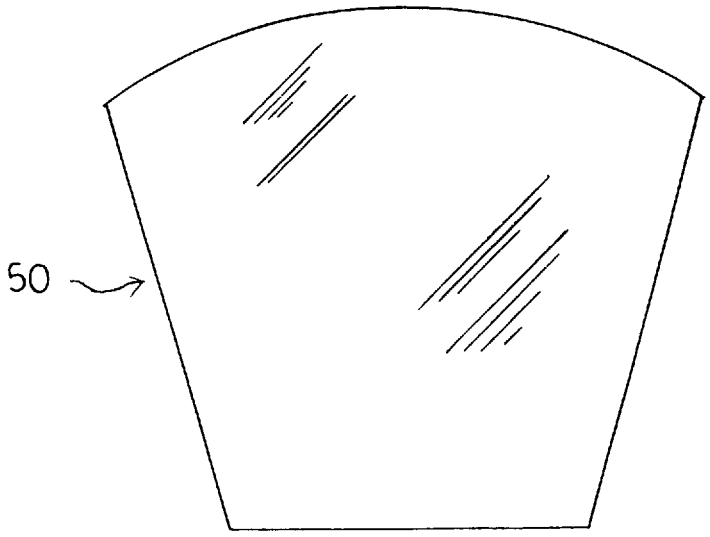
FIG. 9 is a front view of a reflection plate.

Within the central cylinder member 10 positioned inside of the rotary disk 13, as shown in FIG. 8, a fan-shaped reflecting plate 50 (FIG. 9) is accommodated inclined at an angle of about 40 degrees and at a position laterally opposite to the upper reflecting surface of the reflecting plate 50, a rectangular case 51 is formed swelling out from the cylinder member 10.

Within the case 51, two projectors 52, 53 are arranged up and down. These projectors 52, 53 project the same picture image and lights projected from the projectors are reflected by the reflecting plate 50 to form an image of sufficient brightness on the large-sized screen 3 at the upper part.

The picture image projected from the projectors 52, 53 onto the circular large-sized screen 3 is one controlled at an image control section 95 in a main board 90 and an image output board 108 to be mentioned later into a specified shape so as to form a picture just matched with the shape of the circular large-sized screen 3. Therefore, it can be prevented that the projected light is reflected to a part other than the screen 3 to influence the picture.

The picture itself is formed by computer graphics. The projectors 52, 53 have three tubes of red, green and blue, respectively, and the red, green and blue tubes of the upper projector 52 and those of the lower projector 53 are arranged right and left in the reverse order to prevent occurrence of patched color.

By projecting light from the projectors 52, 53 as described above to the large-sized screen 3, a large circular dynamic picture appears at the center of the roulette 2.

Figure 10:
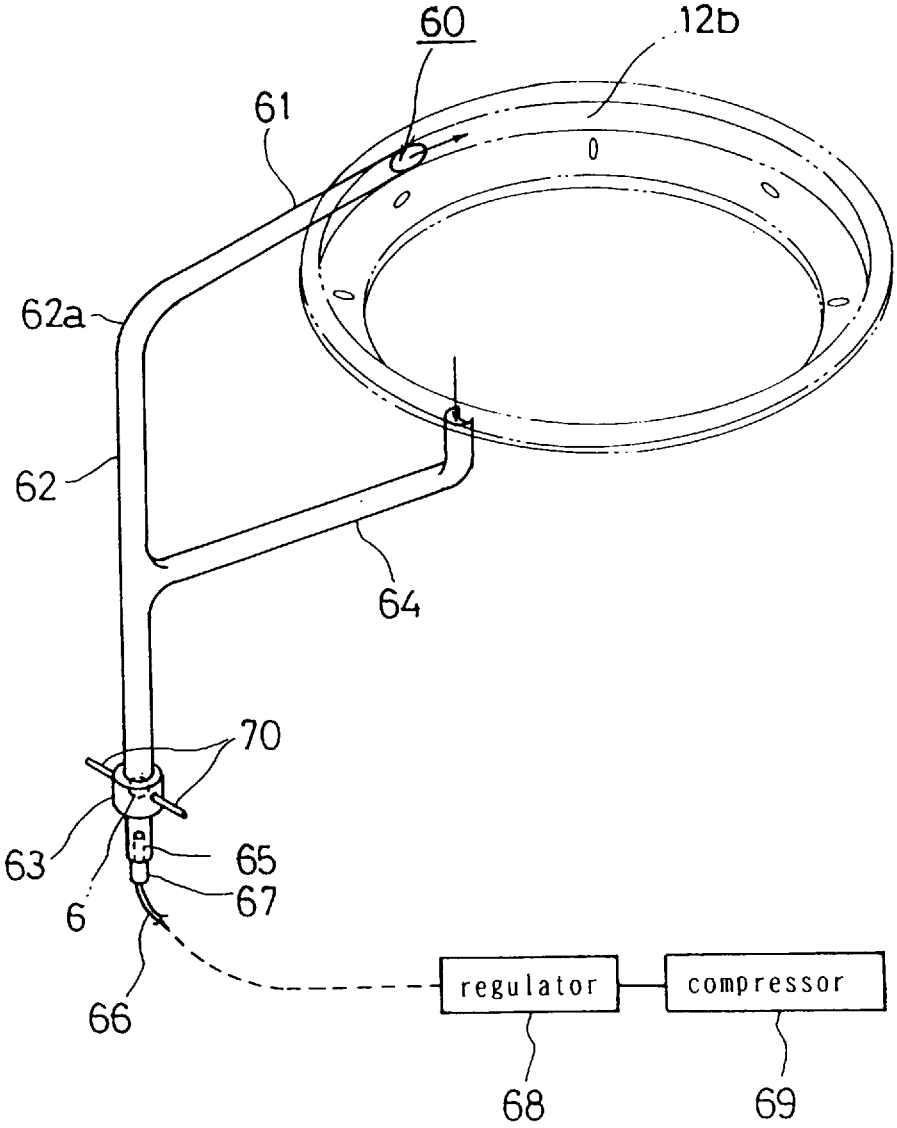
FIG. 10 is a explanatory view showing a construction of a ball shooting device.

Next, a ball shooting apparatus 59 (FIG. 11) for shooting the ball 6 into the roulette 2 will be described based on FIG. 10. An elliptic ball shooting opening 60 is formed at a part of the guide face 12*b* of the guide circle 12 and a ball shooting pipe 61 connected to the opening 60 extends tangentially to the guide face 12*b*. A guide pipe 62 is connected to the ball shooting pipe 61 through a bent part 62*a* and extends downward to a ball set section 63 at the lower end.

The above-mentioned ball recovery pipe 64 is connected to a midway of a vertical passage portion of the guide pipe 62. To a lower part of the ball set section 63 is connected an opening-closing valve 67 through a silencer 65 and to the opening-closing valve 67 are connected an air pressure supply pipe 66, a regulator 68 and a compressor 69 in turn.

Compressed air which is compressed by the compressor 69 and maintained at a predetermined pressure by the regulator 68 is supplied to the ball set section 63 through the air pressure supply pipe 66 when the opening-closing valve 67 is opened, and the ball 6 set in the ball set section 66 is shot out vigorously. The shot out ball 6 reaches the ball shooting opening 60 through the guide pipe 62 and the ball shooting pipe 61, and rushes out along the guide face 12*b* of the guide circle 12.

The opening-closing valve 67 is an electromagnetic valve whose valve opening time can be regulated. The longer the valve opening time, the higher the shooting speed of the ball 6.

The ball 6 recovered in the ball recovery pipe 64 by swinging of the ball recovery plate 27 enters the vertical portion of the guide pipe 62 and falls into the ball set section 63 to be set automatically. A passing through type photo-sensor 70 is arranged at the ball set section 63 to detect the ball 6 set in the ball set section 63.

Figure 2:
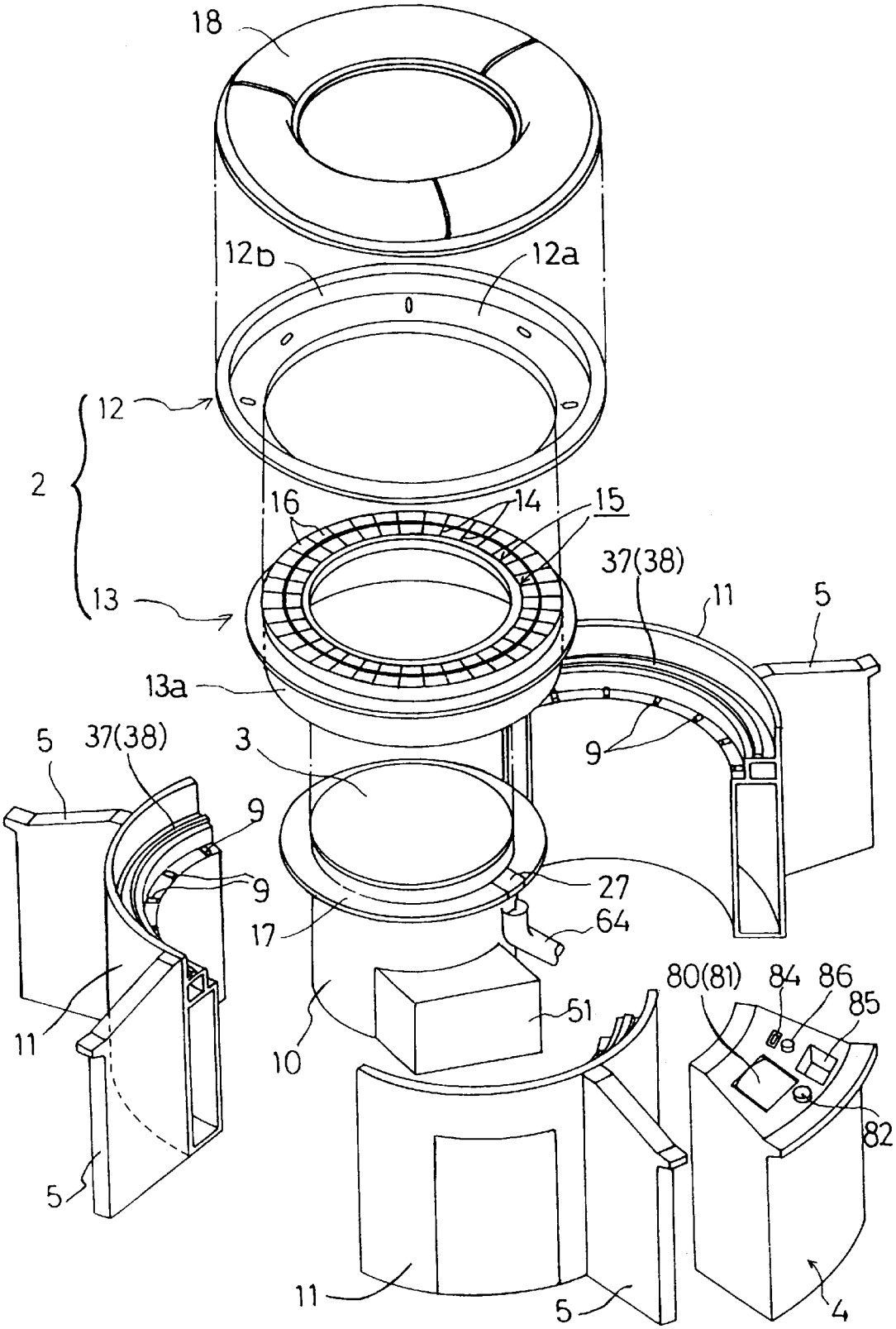
FIG. 2 is a disassembled perspective view of the ball game machine.

As shown in FIGS. 1 and 2 the satellite 4 has an inclined upper face on which a monitor TV 80 is fitted with the TV picture face directed obliquely upward. A touch panel 81 is affixed on the TV picture face. A circular shoot button 82 having a diameter of about 10 cm is arranged at a position in front of the monitor TV 80, and a medal slot 84, a medal return 85 and a medal returning button 86 are arranged on a lateral side of the monitor TV 80.

The shoot button 82 has a pressure sensor 83 (FIG. 11) for detecting pressing force acting on the shoot button. Concretely, the pressure sensor is a piezo-electric element utilizing an electric conductive rubber. The pressing force of the shoot button 82 is received by the electric conductive rubber, resistance value of the electric conductive rubber is changed in accordance with the pressing force and the resistance value is converted to a voltage value for detecting the pressing force.

The detection signal is inputted to the main board 90 through the ball shooting board 105 as described later and used for controlling drive of the opening-closing valve 67 of the ball shooting apparatus 59.

Namely, when the pressure acting on the shoot button 82 is large, the valve opening time of the opening-closing valve 67 is regulated to be long so that the air pressure acts on the ball 6 for a long time to obtain a large ball shooting speed.

Therefore, on manipulation of the shoot button 82, the player can regulate the ball shooting speed by adjusting the pressing force. The player can enjoy an interesting game by manipulating the shoot button 82 with an aim instead of merely shooting the ball.

The ball game machine 1 has a medal returning apparatus and a sound producing apparatus in addition to the above-mentioned structures and is controlled by a computer. FIG. 11 is a rough block diagram of the control system.

The main board 90 of the control system controls progress of the game and has various control managing sections. The motor 42 turning the rotary disk 13 of the roulette 2 is driven and controlled by a driving signal outputted from a rotary disk control section 91 of the main board 90 through a motor driver 100.

When the ball 6 enters into a pocket 15 of the rotary disk 13 and the photo-sensor composed of the light projector 23 and the light receiver 24 detects it, a communication signal informing of the number corresponding to the pocket 15 is transmitted from the infrared transmitter 30 to the infrared receiver 32. The number information received by the infrared receiver 32 is inputted to the ball management control section 92 of the main board 90 through the infrared receiving board 101 to confirm the prize number and the ball management control section 92 turns on and off the lamp 21 of the number plate 16 corresponding to the pocket 15 of the prize number through the lamp control board 102.

Further, the ball management control section 92 drives the recovery solenoid 28 through a solenoid driver 103 to swing the ball recovery plate 27 downward at a suitable timing for recovering the ball 6.

When the shoot button 82 on the satellite 4 is pressed, the pressure sensor 83 detects the pressing force and the detection signal is transmitted through the ball shooting board 105 to the ball shooting control section 93 of the main board 90 in which a valve opening time for the opening-closing valve 67 of the ball shooting apparatus 59 is calculated based on the pressing force. A control signal corresponding to the calculated valve opening time is transmitted to the valve driving apparatus 104 which drives the opening-closing valve 67 so as to be opened during the calculated valve opening time.

The satellite 4 is connected to a satellite board 106 and a medal management section 107. The satellite board 106 interchanges information with the communication control section 94 of the main board 90.

Signals regarding throw-in of the medal, manipulation of the medal returning button 85 and the like are inputted to the medal management section 107 for controlling medal returning and the like and these informations are transmitted to the main board 90 through the satellite board 106.

A bet information signal from the touch panel 81 affixed to the face of the monitor TV 80 arranged on the satellite 4 is inputted to the satellite board 106 and further to the main board 90.

A picture instruction signal is outputted from the communication control section 94 of the main board 90 to the satellite board 106 which controls the picture projected on the monitor TV 80 on the basis of the signal.

In addition, the main board 90 has the picture control section 95 which outputs a game data signal to the picture output board 108. The picture output board 108 outputs a picture signal based on the game data to the projector 52 for driving the projector 52.

The sound control section 96 of the main board 90 outputs a sound signal to the sound board 109 which drives the speaker 111 through the amplifier 110 to generate a sound.

Hereinafter, actions of the ball game machine will be described following the game progress sequence. Before the players begin the game, the large-sized rotary disk 13 is driven by the motor 42 and turning, and an advertising picture is projected on the large-sized screen 3 at the center of the roulette 2 to attract a person's eyes. When the players face to the satellites 4 and throw medals into the medal slots 83, the game starts. Even a single player also can play by himself.

Figure 12:
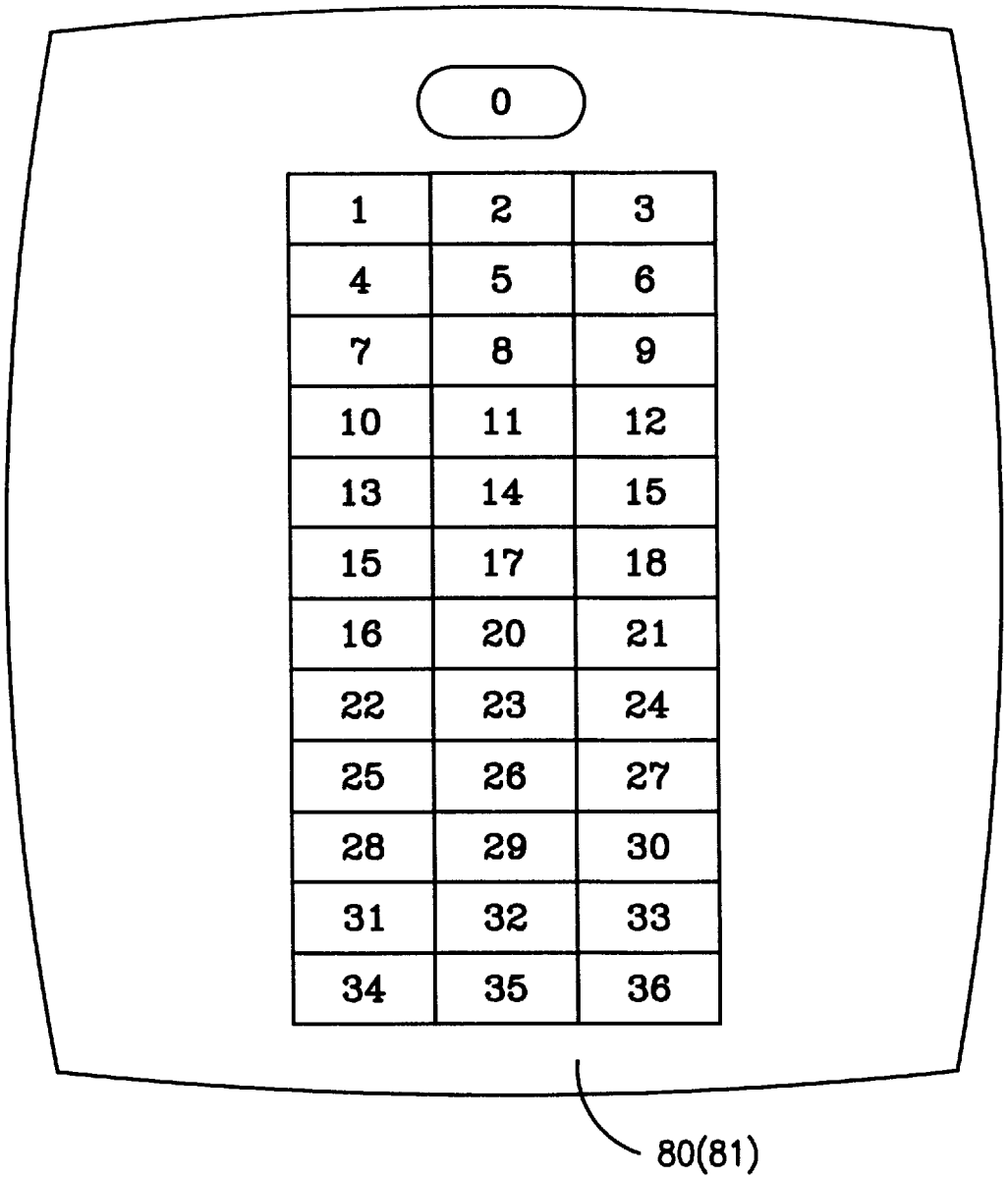
FIG. 12 is a view showing an image on a monitor television.

On the monitor TV 80 of the satellite 4 is displayed a bet table with numerals arranged in order as shown in FIG. 12. The player touches a spot on the table corresponding to an aimed numeral to bet. The touch panel 81 detects the spot and the detection signal is transmitted to the computer to store the betted numeral information. The number of bets can be set by how many times the player touches the touch panel 81.

Figure 13:
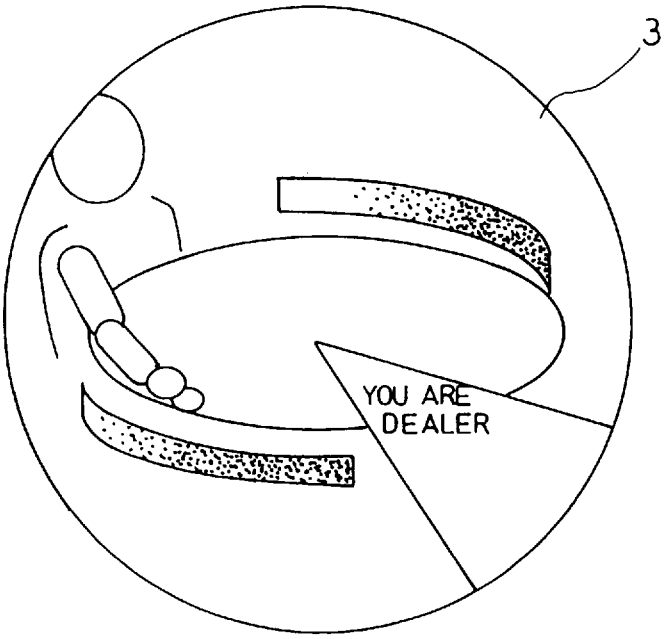
FIG. 13 is a view showing an image on a large-sized screen.
Figure 14:
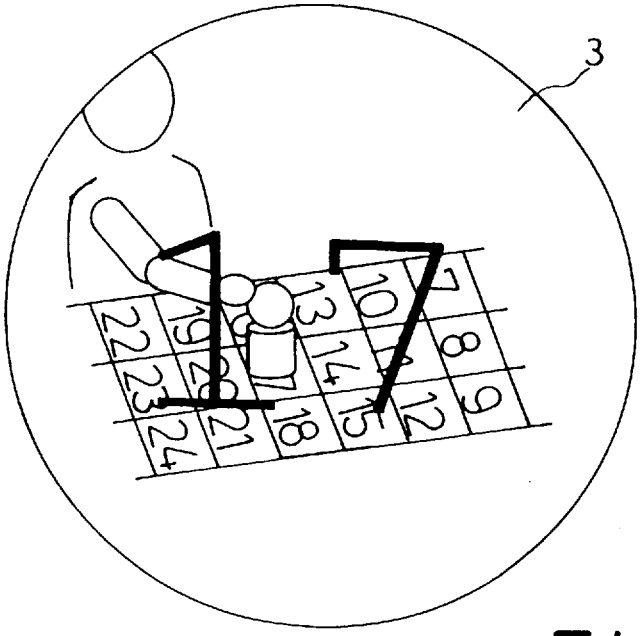
FIG. 14 is a view showing another image on the large-sized screen.
Figure 15:
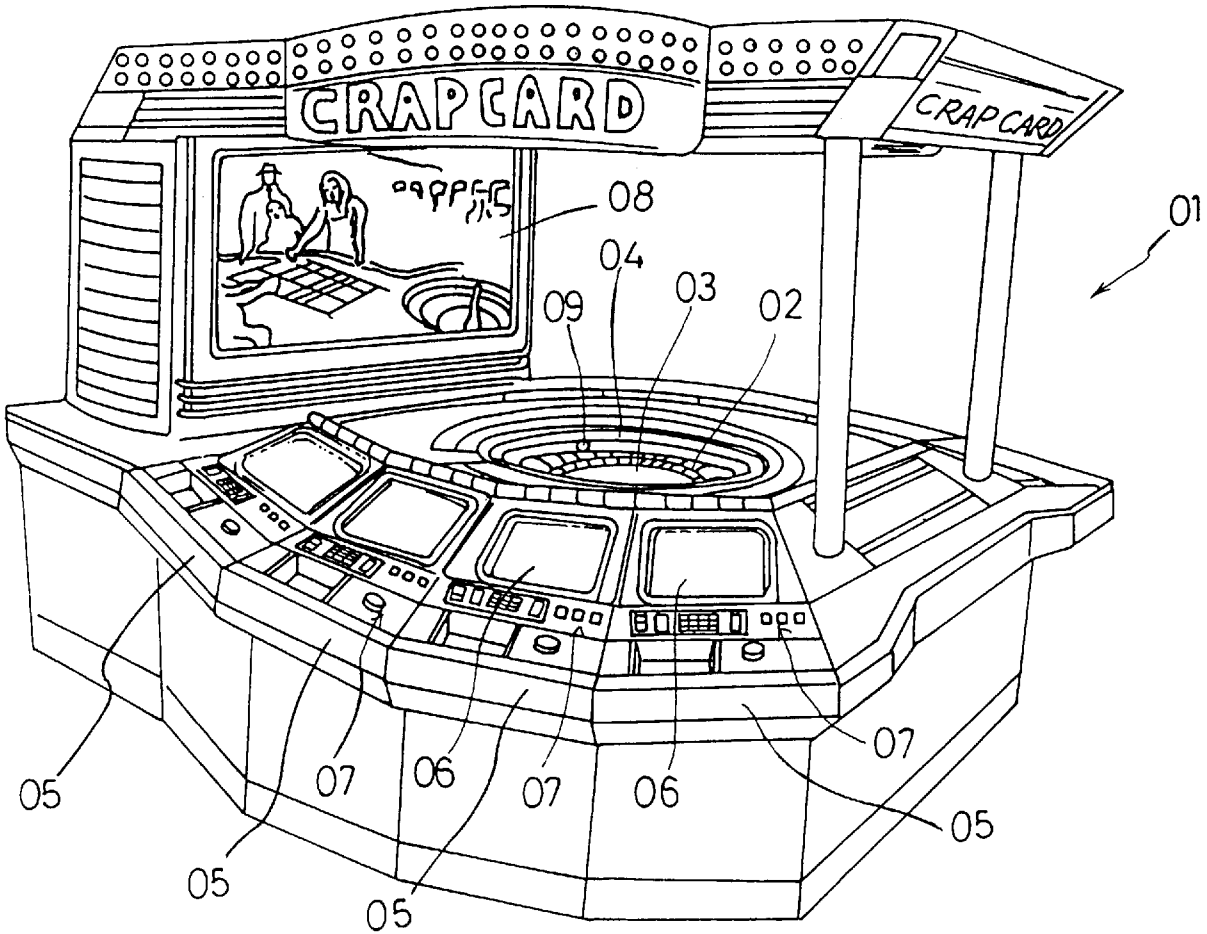
FIG. 15 PRIOR ART
FIG. 15 is an outside view of a customary ball game machine.

In this ball game machine 1, the players act as a dealer in order, and a picture indicating a satellite 4 of a player to be the dealer as shown in FIG. 13 is projected on the large-sized screen 3. Also on the monitor TV 80 of the satellite 4 is given an indication informing of being the dealer.

The player acting as the dealer pushes the shoot button 82 with an adequate pressing force to shoot the ball 6 when bets of players are about over. The betting is possible until about five seconds after the ball is shot. When the betting becomes impossible, a bell rings to notice that the betting is impossible hereafter.

The player acting as the dealer can manipulate the shoot button 82 by adjusting pressing timing and pressing force so that the ball 6 enters into a pocket 15 corresponding to a number he betted on. Since thus the player can participate in the game not only passively but actively, he can be more enthusiastic about the game.

The shot ball 6 rolls along the guide face 12*b* of the guide circle 12 owing to the centrifugal force in the direction opposed to the turning direction of the rotary disk 13, and when the centrifugal force is reduced, the ball rolls down toward the inside along the tapering face 12*a* to reach the turning rotary disk 13 and enters into a pocket 15.

Meanwhile, pictures exhibiting states of the turning roulette are projected on the large-sized screen 3 in changed angles of sight and being enlarged or reduced to give the player visual excitements.

The player traces the ball 6 rolling on the guide circle 12 with his eye and at the same time the picture projected on the large-sized screen 3 at the center catches his eye, so that his excitement to the game is encouraged more and more and he can be enthusiastic about the game.

When the ball 6 enters into a pocket 15, the corresponding lamp 21 is operated and the prize number appears and disappears on the corresponding number plate 16, and at the same time, a situation that the ball is put in the pocket and turning is projected on the large-sized screen 3. Next, a picture showing a large bet table, a dealer pointing his finger at chips on the prize number of the table and an overlapped enlarged prize number (FIG. 14) is projected on the screen 3, and the prize number is called vocally.

When there is any player who has betted on the prize number, a picture showing a dealer paying allotment to a player of the highest allotment is projected on the screen 3 and in case that the allotment is very high, voice generating means of the corresponding satellite generates a voice "nice catch".

Numbers around the betted number are also paid allotments, though the rates are low since the probability of the allotment is large.

The ball 6 in the pocket 15 rotating together with the rotary disk 13 comes to the place provided with the ball recovery plate 27 after a while and falls along the plate 27 swung downward by the recovery solenoid 28. Then the ball 6 is guided by the ball recovery pipe 64 to be automatically set in the ball set section 63. The photo-sensor 70 detects the ball set in the section 63 and the next play is ready.

In the next play, the dealer is switched to the neighboring player to reopen the game and the above actions are repeated. If the medal returning button 86 of the satellite 4 is pushed to end the game, won medals are returned at the medal return 85.

According to the present invention, since the large-sized screen 3 is arranged at the center of the large-sized roulette 2 of the ball game machine and a picture giving a visual stimulus is projected on the screen, the, player's eyes catch the picture without altering his line of sight largely, his excitement to the game is encouraged more and more by the visual stimulus and he can be enthusiastic about the game.

Since the large-sized circular picture surface is formed utilizing the central space of the rotary disk, a special space for the picture surface is unnecessary and a good installation space efficiency is attainable. Further, the number of operation stands is not limited by the picture surface so that the number of the players who can play simultaneously can be increased.

Since the picture surface is a large-sized circular screen spreader in a plane and the image projector projects various pictures on the screen, pictures which can be easily seen by the players can be provided.

Since the image projector as the picture formation means is constituted so as to project images matched with the shape of the large-sized circular screen, it can be prevented that a light reflects on a part other than the screen to influence the projected image.

Since two sets of the image projector are used as the picture formation means, images having sufficient brightness can be projected on the large-sized screen.

Since each of the two image projectors has three tubes of red, green and blue and corresponding tubes of the same color of both image projectors are arranged at positions symmetrical with each other, occurrence of patched color can be prevented.

Since the picture formation means is controlled by a control means for controlling progress of the game for changing the pictures in accordance with the progress of the game, it is possible to provide pictures matching with the game progress to the players, facilitate the play and give a strong visual effect to the players.

What is claimed is:

1. A game machine simulating a roulette, comprising:

a rotary annular disk with a plurality of pockets arranged in a peripheral direction and assigned a number respectively;

a guide circle provided around the rotary annular disk for guiding a rolling ball along;

a plurality of operation stands around said guide circle;

a picture surface disposed within a central space surrounded by said rotary annular disk; and a picture formation means for forming various pictures on said picture surface.

2. A game machine, comprising:

a roulette wheel with a plurality of pockets arranged in a peripheral direction and assigned a number respectively, including means for guiding a rolling ball;

plurality of operation stands provided around said roulette wheel;

a picture surface disposed within a central space surrounded by said roulette wheel; and a picture formation means for forming various pictures on said picture surface.

3. A game machine claimed in claim 1 or 2, wherein said picture surface is formed by a large-sized substantially circular screen spread generally in a plane, and said picture formation means is an image projector adapted to project various images onto said large-sized screen.

4. A game machine claimed in claim 3, wherein said image projector projects images matched with a shape of said large-sized substantially circular screen.

5. A game machine claimed in claim 4, wherein two sets of said image projector are provided.

6. A game machine claimed in claim 5, wherein each of said two projectors has three tubes of different colors and corresponding tubes of the same color of both image projectors are arranged at positions symmetrical with each other.

7. A game machine claimed in claim 1 or 2 wherein said picture formation means is controlled by a control means for controlling progress of the game to change the pictures in accordance with the progress of the game.

* * * * *